US009057165B2

(12) United States Patent
Sagy

(10) Patent No.: US 9,057,165 B2
(45) Date of Patent: Jun. 16, 2015

(54) SAFETY CRASH BARRIER

(76) Inventor: Alexander Sagy, Omer (IL)

( * ) Notice: Subject to any disclaimer, the term of this patent is extended or adjusted under 35 U.S.C. 154(b) by 0 days.

(21) Appl. No.: 14/110,756

(22) PCT Filed: Apr. 15, 2012

(86) PCT No.: PCT/IL2012/000160
§ 371 (c)(1),
(2), (4) Date: Dec. 12, 2013

(87) PCT Pub. No.: WO2012/140651
PCT Pub. Date: Oct. 18, 2012

(65) Prior Publication Data

US 2014/0308072 A1 Oct. 16, 2014

(30) Foreign Application Priority Data

Apr. 13, 2011 (IL) ..... 212288

(51) Int. Cl.
*E01F 15/00* (2006.01)
*E01F 15/08* (2006.01)
*E01F 15/02* (2006.01)

(52) U.S. Cl.
CPC ..... *E01F 15/083* (2013.01); *E01F 15/025* (2013.01); *E01F 15/088* (2013.01)

(58) Field of Classification Search
CPC ..... E01F 15/083; E01F 15/088; E01F 15/025
USPC ..... 404/6, 9, 73; 256/13.1
See application file for complete search history.

(56) References Cited

U.S. PATENT DOCUMENTS

| | | | | | |
|---|---|---|---|---|---|
| 4,681,302 | A | * | 7/1987 | Thompson | 256/13.1 |
| 4,854,767 | A | * | 8/1989 | Sasaki | 404/6 |
| 4,982,535 | A | * | 1/1991 | Pickett | 52/71 |
| 5,022,781 | A | * | 6/1991 | Smith | 404/6 |
| 5,118,216 | A | * | 6/1992 | Smith | 404/6 |
| 5,123,773 | A | * | 6/1992 | Yodock | 404/6 |
| 5,685,665 | A | | 11/1997 | Lembo | |

(Continued)

FOREIGN PATENT DOCUMENTS

| | | |
|---|---|---|
| JP | 2002275844 | 9/2002 |
| JP | 2009221747 | 10/2009 |

OTHER PUBLICATIONS

PCT/IL2012/000160 Search Report of the international search authority, Jan. 2013.

*Primary Examiner* — Raymond W Addie
(74) *Attorney, Agent, or Firm* — Nathan & Associates Patent Agents Ltd.; Menachem Nathan

(57) ABSTRACT

Disclosed in a safety crash barrier comprising an elongated base portion and a plurality of barrier elements movably coupled in a resting state thereof to and along the base portion, the plurality of barrier elements are configured to flexibly or elastically change into a displaced state in which at least some of said barrier elements contacted by a colliding vehicle are caused to move and absorb impact energy imparted by the vehicle so as to stop movement of the vehicle or deflect it back to its lane, to thereby reduce or prevent damages to the vehicle and/or passengers injuries. In some embodiments of the present invention a structure of a plurality of barrier modules is slidably placed on top of the base portion, the plurality of barrier modules are placed one on top the other and configured to horizontally slide one relative the other in response to impact of a colliding vehicle contacting the barrier.

21 Claims, 9 Drawing Sheets

(56) References Cited

U.S. PATENT DOCUMENTS

| | | | | |
|---|---|---|---|---|
| 7,198,426 | B2 * | 4/2007 | Kang | 404/6 |
| 7,303,353 | B2 * | 12/2007 | Carey | 404/6 |
| 7,708,492 | B2 * | 5/2010 | Carey | 404/6 |
| 7,722,282 | B2 | 5/2010 | Meidan | |
| 2012/0207541 | A1 * | 8/2012 | Maus et al. | 404/6 |

* cited by examiner

Fig. 1C
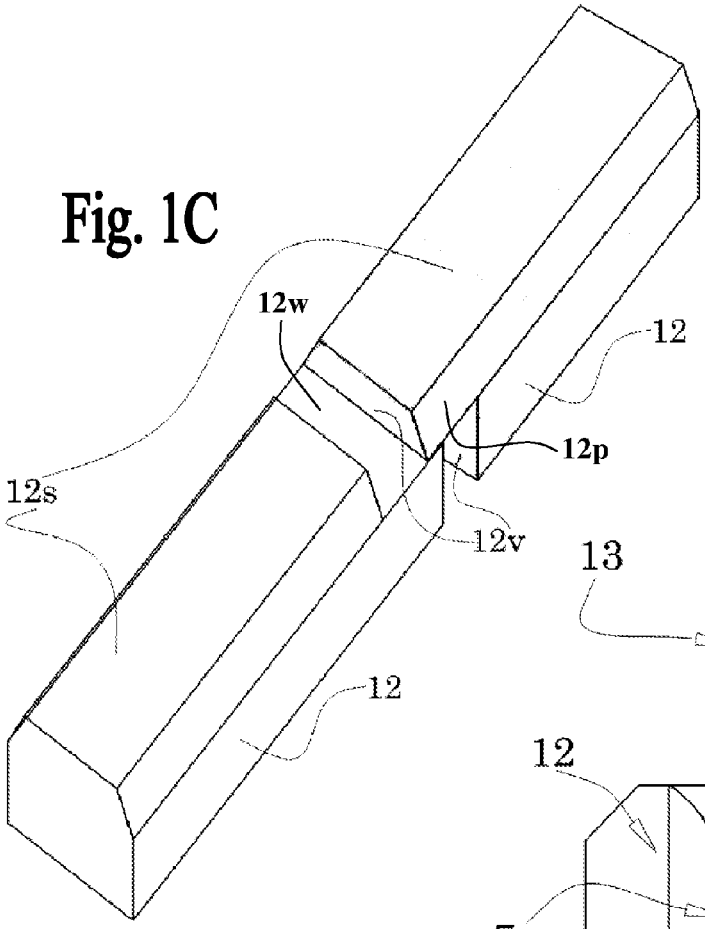
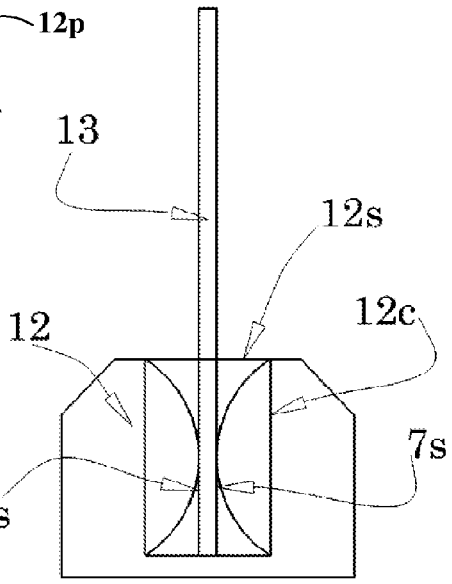
Fig. 1D
Fig. 1E
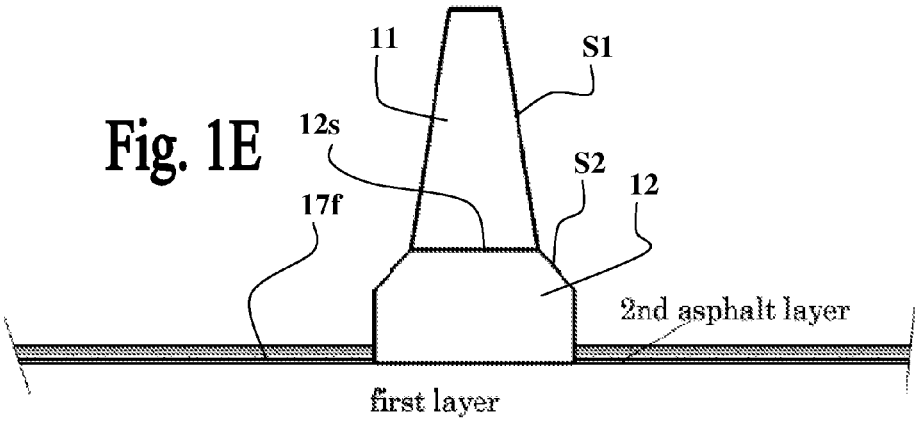

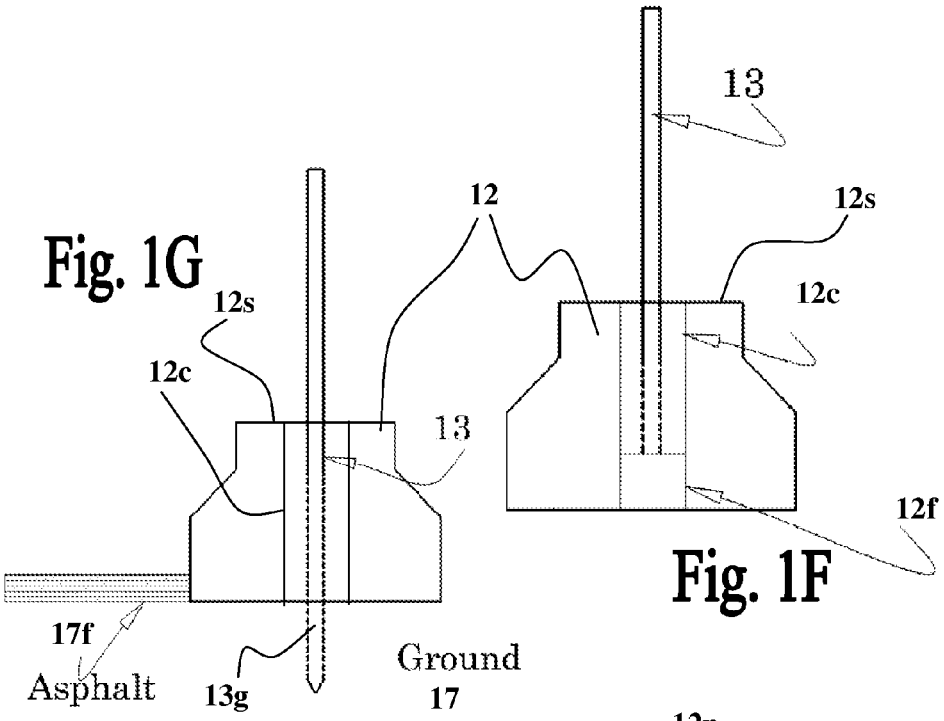
Fig. 1G
Fig. 1F
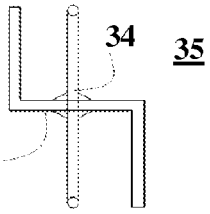
Fig. 1H
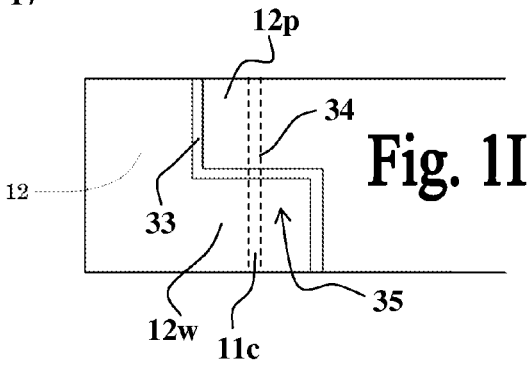
Fig. 1I
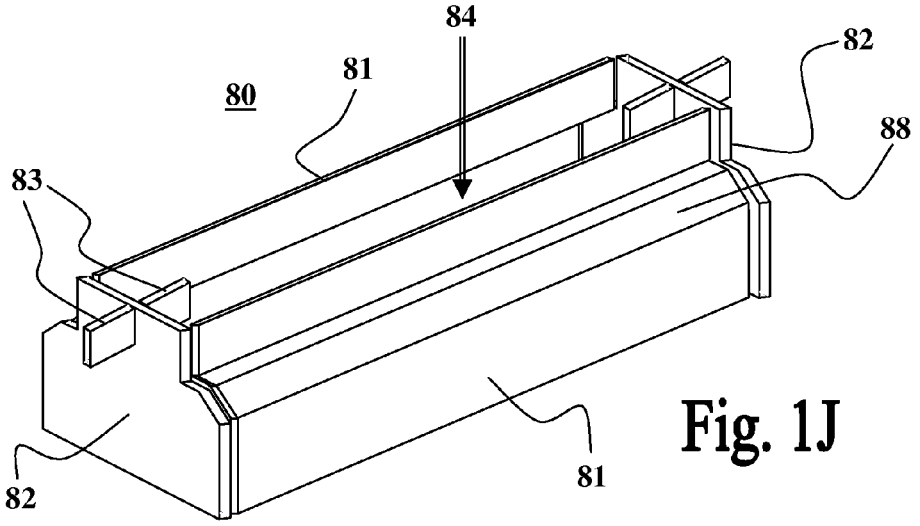
Fig. 1J

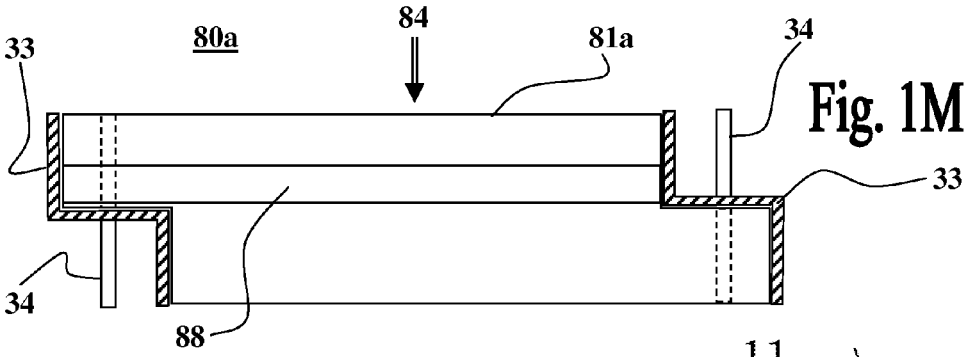
Fig. 1M
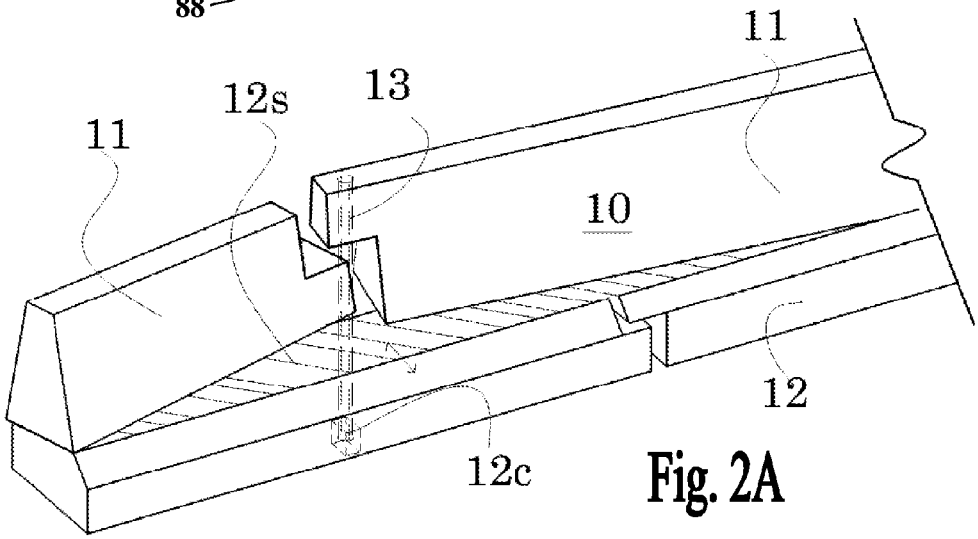
Fig. 2A
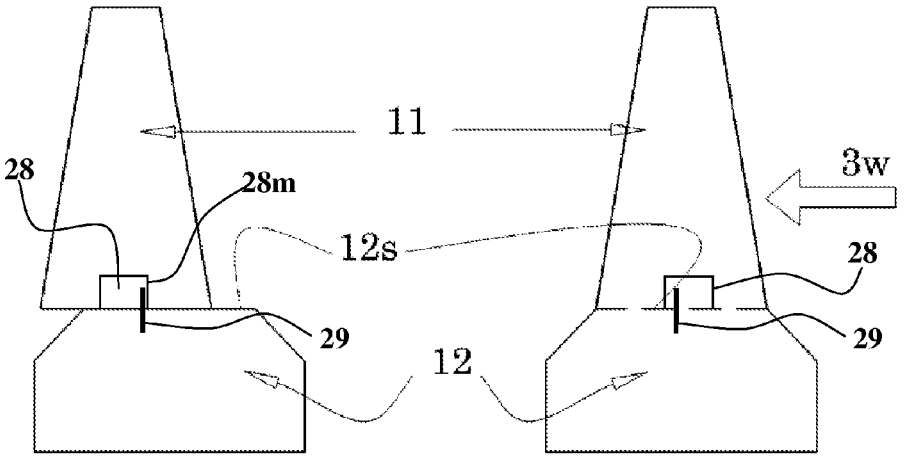
Fig. 2C
Fig. 2B

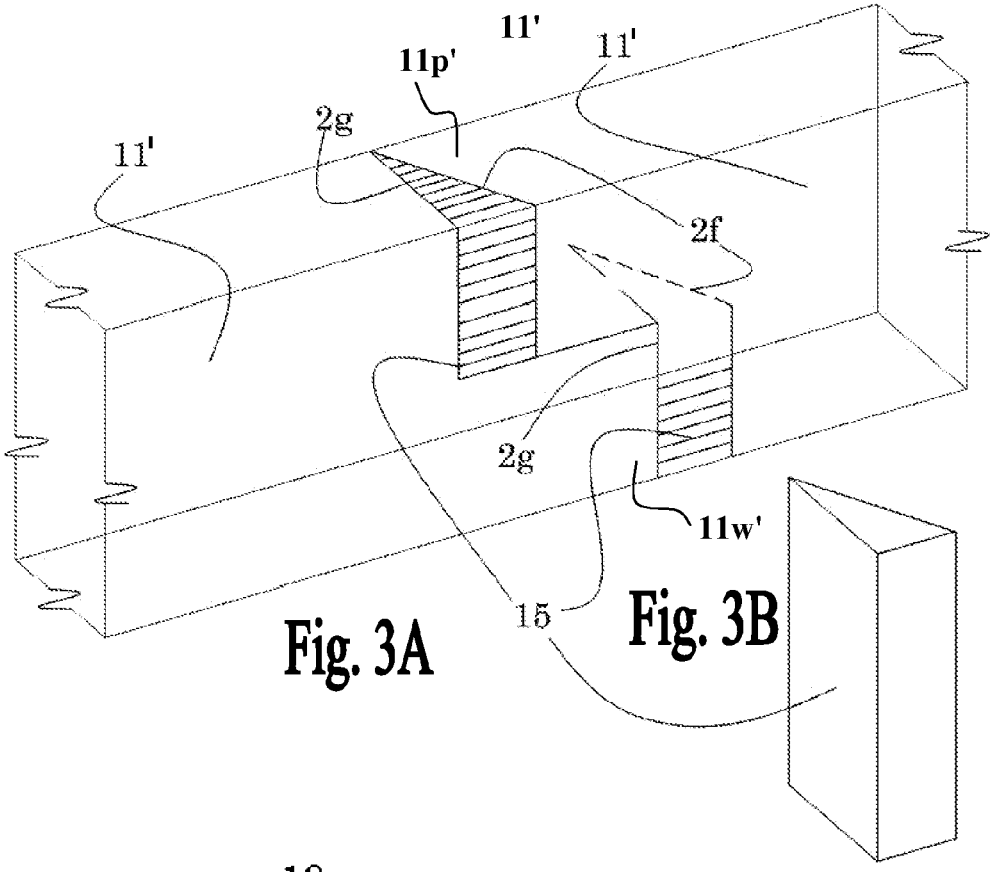
Fig. 3A
Fig. 3B
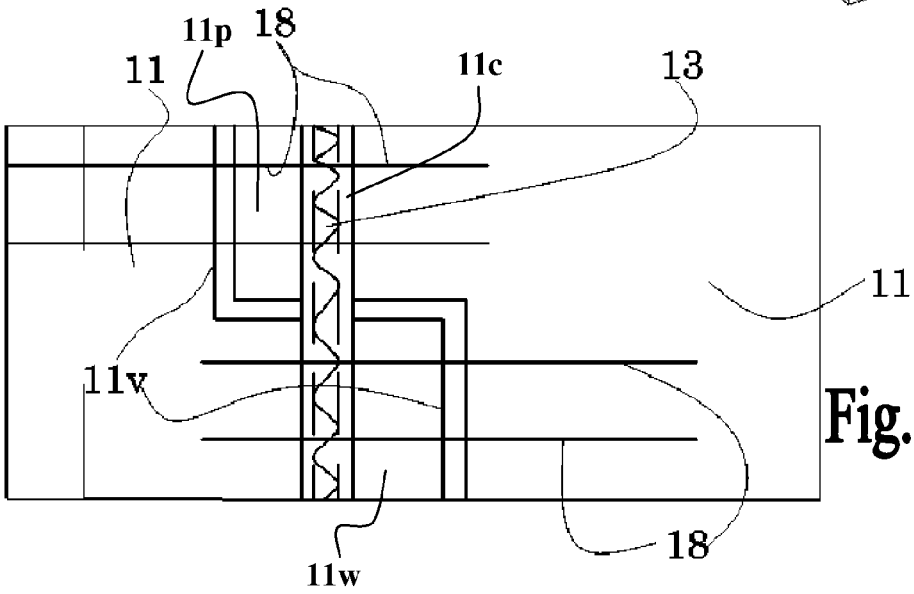
Fig. 4A
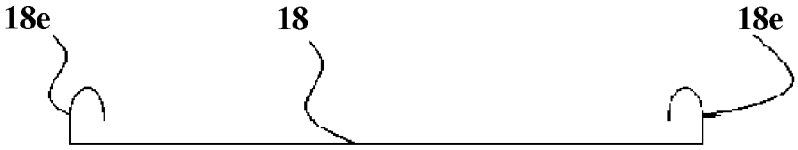
Fig. 4B

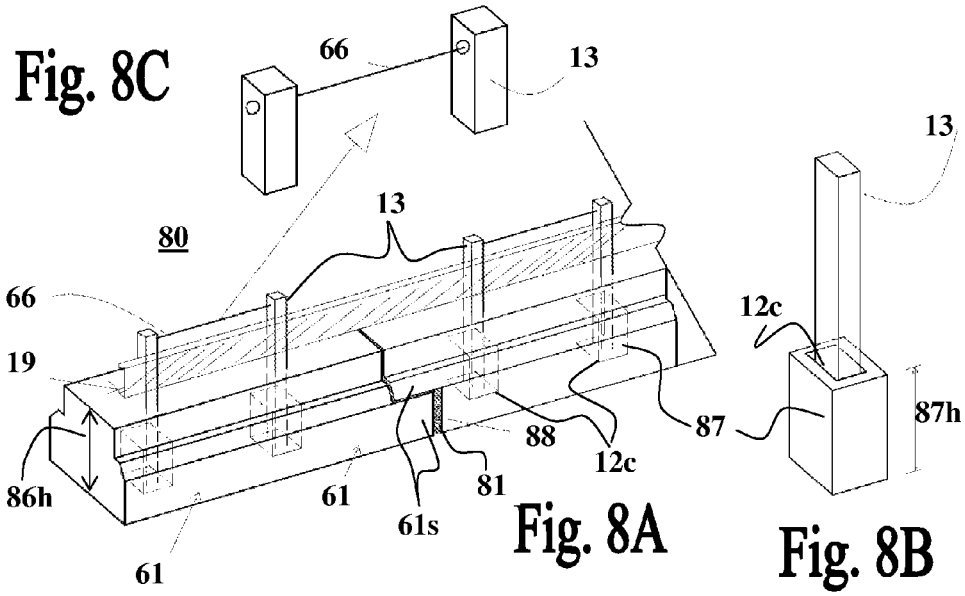
Fig. 8C
Fig. 8A
Fig. 8B
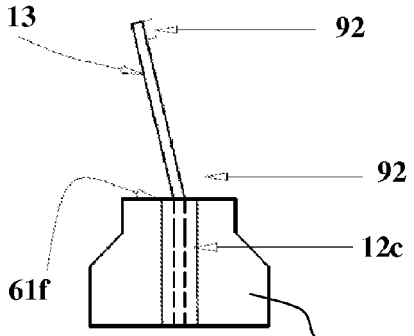
Fig. 9B
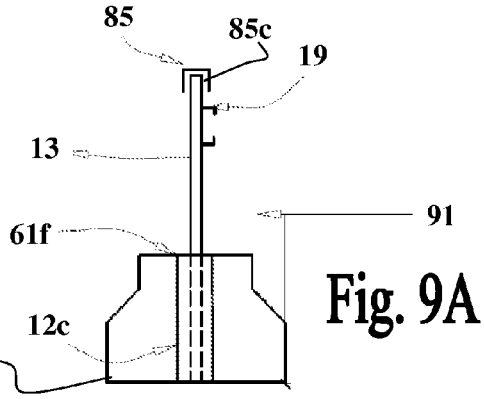
Fig. 9A
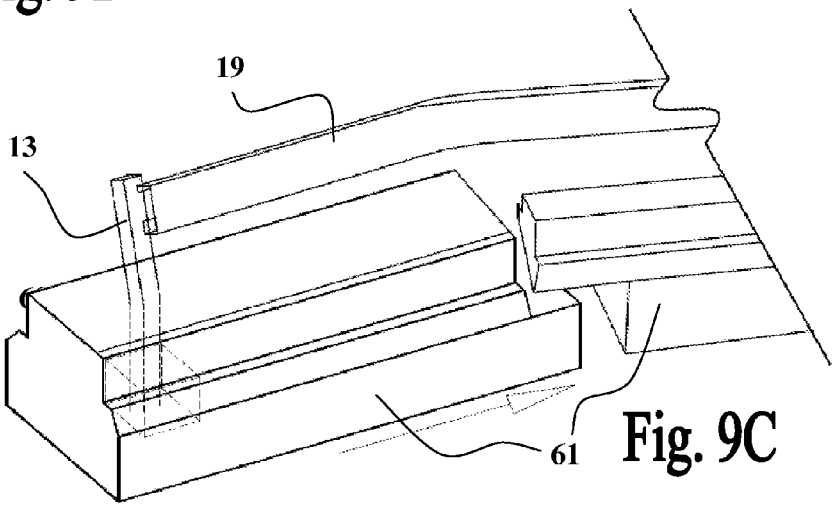
Fig. 9C

SAFETY CRASH BARRIER

CROSS REFERENCE TO RELATED APPLICATIONS

This application is a National Phase application of PCT patent application PCT/IL2012/000160 and is related to and hereby claims the priority benefit of IL Patent Application No. 212288 titled "Safety Crash Barrier" and filed Apr. 13, 2011, which is incorporated herein by reference in its entirety.

FIELD OF THE INVENTION

The present invention relates to crash barriers. More particularly, the present invention relates to a safety crash barrier structures particularly useful for roads, tunnels, bridges and highways, and to methods for production, installing and repairing the same.

BACKGROUND OF THE INVENTION

Safety crash barriers are used to prevent vehicles from leaving the roadway and so to improve road safety and especially passengers' safety.

Road safety barriers are widely implemented nowadays by solid concrete crash barriers used as an alternative to the traditional steel crash barriers. These barriers are some times fabricated from combinations of different materials, such as plastic, steel, wood, or metallic cables, for example.

Many of the solid crash barriers used nowadays are a type of the so-called "step" barrier", or the "New Jersey" barrier (or Jersey wall), which is a cast-in-place or a modular precast concrete barrier having a stepped profile designed to reduce the injury to passengers of a vehicle in cases of incidental contact, and to prevent car crossover. In many cases the stepped design of these barriers deflects the colliding vehicle back to the traffic lane and prevents passenger injury and damage to the colliding vehicle.

Concrete crash barriers are designed to direct the colliding vehicle along the face of the barrier in the direction of the traffic flow, to limit the vehicle contact with the crash barrier to the base of the barrier (i.e., the stepped section or slope) and the vehicle wheels, such that the vehicle's wheels and its suspension system absorb the impact, which in most cases allows the vehicle to return to its lane almost undamaged with minimal injury to the passengers. These features are of immense importance and desirous in newly developed road crash barriers, such as provided in the present invention.

Some times, however, the colliding vehicle "stops" on the crash barrier, or goes over the crash barrier. In both cases the pressure and impact on the passengers in the vehicle is very intense and dangerous.

Concrete crash barriers have many advantages over the traditional steel crash barrier, to name a few:

- compliant to all vehicles, including most buses, coaches, trucks and light vans up to 13.5 tons (whereas steel barriers are only useful for cars up to 2 tons in weight when taking in account cost economy);
- substantial reduction of chances of vehicle crossing central reserve and reaching the opposite lane or falling to a lower surface (e.g., chasm);
- substantial reduction of maintenance costs (concrete step barrier requires almost no maintenance or barrier repair, and usually there is no need for lane closure-after incidents which also reduce chances of incidents during repair process); and
- having a life duration of about 50 years (compared to 25 years of traditional metal barriers).

Safety crash barriers are categorized by a severity index known as ASI (Acceleration Severity Index). The ASI index indicates the possible injury level to vehicle occupants in case of an impact with the barrier. The higher the ASI index, the greater the risk of passengers injuries. Most concrete stepped barriers have an ASI of about 1.6 (the pre-cast high cost concrete barriers have ASI of about 1.0-1.6 and therefore their use is very limited) which may not be acceptable in most cases (by law or code), and also have higher risks for severe injuries.

An improved stepped concrete design is described in U.S. Pat. No. 7,722,282, the entire disclosure of which is incorporated herein by reference, in which the crash barrier is comprised from a plurality of modular elements having a shoulder section and coupling means designed to resiliently interconnect the elements.

There is still a need for solid safety crash barriers, possibly made of concrete, metal, wood or plastic, having improved abilities to absorb vehicles impacts, prevent the colliding vehicles from going over to the opposite lane or fall to a lower surface, and deflect colliding vehicles back into their lanes, while minimizing passengers' injuries.

It is therefore an object of the present invention to provide a safety crash barrier made of solid elements, such as concrete elements, combined sometimes with other materials or elements, having improved impact absorbance capabilities.

It is another object of the present invention to provide a method for constructing and upgrading (repairing) solid safety crash bathers having improved impact absorbance capabilities.

It is yet another object of the present invention to provide a method of converting conventional concrete barriers to comply with principles of the crash barrier of the present invention to improve their energy absorbance properties and improve their ASI values.

It is a further object of the present invention to provide a crash barrier mechanism effective for preventing or reducing passengers' injuries and vehicle damages, and which is relatively simple, easy and cost effective, to repair and construct.

It is yet a further object of the present invention to provide a crash barrier that is strong, massive and of low costs for maintenance and low cost to manufacture and assemble comparing to precast methods, and having improved elasticity and/or flexibility, and energy absorbing, properties.

Other objects and advantages of the invention will become apparent as the description proceeds.

SUMMARY OF THE INVENTION

The present invention aims to provide improved safety crash barrier structures (having improved ASI parameters), and methods of constructing the same. In general, safety crash barrier embodiments of the present invention are comprised of an elongated base portion and a plurality of barrier elements movably coupled in a resting state thereof to and along the base portion configured to change into a displaced state in which at least some of said barrier elements contacted by a colliding vehicle are caused to move and absorb impact energy imparted by the vehicle so as to stop movement of the vehicle.

Advantageously, the barrier elements are configured to flexibly or elastically change into their displaced state. For example, the plurality of barrier elements may be configured to at least partially restore their states back into the resting state after being changed into the displaced state due to the contact with the colliding vehicle. In this way crash barrier can deflect the colliding vehicle back into its lane as the barrier elements restore their states back into the resting state after being hit by the colliding vehicle.

In some possible embodiments of the present invention some or all of the barrier elements are configured to slide over the base section in response to impact (e.g., colliding vehicle), and thereby to allow absorbing the impact energy. The crash barrier may further comprise a plurality of coupling rods coupled to the base portion with some freedom to move or tilt, thereby allowing absorbance of some of the impact energy. Optionally, the plurality of barrier elements are coupled to the coupling rods. Optionally, the plurality of barrier elements are interconnected.

Crash barrier structures of the present invention may be constructed by placing an elongated base at a barrier site (e.g., precast or cast-in-situ using molds configured to allow to move and absorb the impact energy) placing a plurality of bather modules on the elongated base, and engaging/interconnecting between pairs of adjacent barrier modules (e.g., to obtain a connected elastic structure). The placing of the plurality of barrier modules may comprise placing the plurality of barrier models on the elongated base, connecting between adjacent barrier modules by engaging mating shoulders provided in of each of the adjacent barrier modules, and placing a connecting rod in a pass-through bore defined by bores provided in the mating shoulders of the adjacent barrier modules.

Optionally, end portions of the connecting rods are received in a cushioning channel provided in the elongated base. Optionally, placing the elongated base comprises interconnecting/engaging between a plurality of base segments (e.g., having a generally rectangular shape). Interconnecting/engaging the plurality of base segments may comprise passing a stake through a connecting bore defined by bores provided in mating shoulder of the adjacent base segments, such that a lower end portion of said stake is introduced into one of: ground, road, and a pipe placed in said ground or road.

According to some embodiments of the present invention there is provided a safety crash barrier comprising a base portion, a plurality of coupling rods attached to the base portion, and a plurality of barrier elements coupled to the base portion by means of the coupling rods. The plurality of coupling rods may be vertically attached to the base portion with some freedom to move or tilt. The base portion may comprise a plurality of cushioning channels each configured to receive and hold a portion of a coupling rod while providing the coupling rod some freedom to move or tilt thereinside. Optionally, the coupling rods are made form an elastic or resilient material. More optionally, each cushioning channel comprises elastic components (e.g., springs and/or energy absorbing materials such as rubber, or Neopran, or recycled energy absorbing materials such as recycled tires) configured to elastically absorb movements or tilts of the coupling rod received thereinside.

Advantageously, the barrier elements may be interconnected. The crash barrier of the present invention may be implemented in various ways allowing improved absorbance of impact energy by the base and by the interconnected barrier modules, as described in details hereinbelow.

Optionally, the barrier elements are elongated metallic, wood, or plastic beam, or cable, elements attached to upper portions of the coupling rods, thereby connecting between two or more adjacent coupling rods. The upper surface of the base portion may define a friction surface configured to slowdown and stop a colliding vehicle. For example, the upper surface of the base portion may be processed and roughened to provide increased friction properties (e.g., having friction coefficient in a range of 0.15 to 0.95, optionally of about 0.5).

Alternatively, the barrier elements are solid modules generally rectangular in shape having upper, lower, and side faces, wherein the solid barrier modules are positioned with their lower sides on top and along a length of the base portion and coupled to the base portion by means of one, two or more coupling rods.

Optionally adjacent solid barrier modules are interconnected. For instance, adjacent solid barrier modules may be interconnected employing any conventional connecting means, as known in the art (e.g., connecting element such as coupling rod, cables, wires, or metal bars). For example, each pair of adjacent solid barrier modules may be interconnected by means of a rectangular plate (e.g., metallic or plastic) which extremities are connected to each of the bather module by conventional connecting means, such as connecting pins received in respective bores or sockets provided in the barrier modules, or bolts and nuts, for example.

In some possible embodiments of the present invention adjacent solid barrier modules are interconnected by one of the plurality of coupling rods, such as described in U.S. Pat. No. 7,722,282.

Advantageously, the base portion has a smooth upper surface defining a skid surface on which the solid barrier modules are slidably situated. The skid surface may be polished and/or have one or more smoothing layers (e.g., sprayed silicon, lubricant layers, or plastic layers) applied thereon. The friction coefficient between the lower face of the solid barrier modules and the skid surface may generally be in the range of 0.1 to 0.95, optionally about 0.3.

Additionally or alternatively, the solid barrier modules are made as precast elements having smoothed lower surface for reducing the friction coefficient between the upper surface of the base portion and the solid barrier modules (e.g., the lower face of the barriers are precast elements a smooth surface).

The solid barrier modules may be fabricated from concrete (e.g., using pre-cast molds) with faceted surface portions formed on their side faces configured to mate with faceted surface portions of an adjacent barrier module. Optionally, the faceted surface portions of adjacent barrier modules define mating shoulders each of which comprising an aligning bore configured to define a pass-through bore used to interconnect adjacent barrier modules by passing through the pass-through bore one of the plurality of coupling rods. Optionally, the coupling rods are passed through the pass-through bores and through the base portion such that their lower end sections are introduced into the ground or the road.

Optionally, the base portion is comprised of a plurality of generally rectangular elongated base segments. Adjacent base segments may be interconnected employing conventional connecting elements, as known in the art and described hereinabove and hereinbelow. In some embodiments of the present invention adjacent base segments are interconnected by fitting a rectangular coupling plate inside a longitudinal channel or bore formed in the extremities of each pair of adjacent base segments.

Optionally, the base portion is comprised of a plurality of generally rectangular elongated base segments having upper, lower, and side faces, wherein each side face having at least one mating shoulder configured to contact and fit with a mating shoulder of an adjacent elongated base segment. The base segments may be movably placed on the ground or on a road interconnected by their mating shoulders. Alternatively, the base segments may be fixedly anchored to the ground or the road surface. The mating shoulders of adjacent base elements may comprise a connecting bore passing through them and configured to receive a coupling stake which lower end portion is introduced into the ground, the road, or into a pipe placed in the ground or road. The connecting bore and the stake passed therethrough may be configured to allow the base elements a minimum movement ability for improving the ASI index by enabling the barrier to stop the movement of the colliding vehicle with a good working width (W3 to W4), or other working widths according to the needs of the project. The connecting bore may be filled with an energy absorbing material such as rubber or Neopran.

The base portion may be configured to provide a stepped configuration (e.g., Jersey barrier configuration) such that a colliding vehicle hitting the safety crash barrier of the present invention first contacts the stepped base portion which may deflect the vehicle back to its traffic lane.

If the colliding vehicle does not deflect back to its lane, the vehicle chassis typically hits the barrier elements movably attached to the base portion such that the impact energy is transferred to the connecting rods, which acts as restraining elements. The connecting rods may move or tilt within the cushioning channels, and if the colliding vehicle does not deflect back to its lane, the connecting rods will start to deform, as they are pressed against the margins of the cushioning channel, until the colliding vehicle is stopped, or moves away in the direction of the road.

If the cushioning channel comprises elastic elements the state of the connecting rods, and of the barrier elements attached to them, may be restored after the colliding vehicle deflects back to its lane.

According to some other embodiments of the present invention there is provided a method of constructing a crash barrier at a barrier site (e.g., road, bridge, tunnel), comprising placing an elongated base at the barrier site, and placing a plurality of interconnected barrier modules on the elongated base. Optionally, each barrier module of the plurality of barrier modules has faceted side portions configured to mate with faceted side portions of an adjacent barrier module of the plurality of barrier modules.

The elongated base (e.g. continuous cast-in-place) may comprise a plurality of cushioning channels configured to receive and hold end portion of a connecting rod while allowing movement or tilt of the connecting rod thereinside. Each barrier module of the plurality of barrier modules may generally be solid rectangular module having an upper and lower faces and two side faces. Each side face may have at least one mating shoulder having a bore, the at least one mating shoulder configured to mate with at least one mating shoulder of an adjacent barrier module of the plurality of barrier modules such that the bores of the mating shoulders align to define a continuous pass-through bore. Placing the plurality of interconnected barrier modules may comprise placing the plurality of barrier modules on the elongated base such that connection between adjacent barrier modules is obtained by the mating shoulders and by placing a connecting rod in each pass-through bore such that end portion of the connecting rod is received in one of the plurality of cushioning channels.

The elongated base may comprise a plurality of base segments each of which having a generally rectangular shape with upper and lower faces and two side faces, each side face having at least one mating shoulder configured to mate with at least one mating shoulder of an adjacent base segment. Optionally, the at least one mating shoulder comprises a bore configured to align with the bore of the at least one mating shoulder of the adjacent base segment and define a connecting bore. The step of placing the elongated base may further comprise passing a stake through the connecting bore such that a lower end portion of the stake is introduced into the ground, road, or into a pipe placed in the ground or road.

The elongated base may be manufactured onsite using cast-in-place techniques. Optionally, a mold is utilized with the cast-in-place machinery to form generally rectangular base segments. The mold may be further configured to form longitudinal channels in the extremities of adjacent pairs of base segments, adapted to receive a coupling plate for interconnecting adjacent base segments. Alternatively, the mold is configured to form connecting shoulders in the extremities of adjacent base segments and a connecting bore passing through the connecting shoulders in which a coupling stake may be introduced, as described hereinabove and hereinbelow. These cast-in-place techniques may be also carried out utilizing a "moving" form, as done nowadays in the casting of full height new jersey step barriers, and also in conventional steel, wood or plastic barrier forms.

It is also possible to build crash barrier embodiments of the present invention in a two stage process, wherein the base portion is casted first followed by casting of the upper barrier modules, or placing precast upper barrier elements above (on top of) the base. In another alternative embodiment of the present invention steel, wood or plastic beams, and/or cables, are coupled to the base.

The present invention further relates to a method of converting a conventional stepped (or jersey-type) crash barrier to a crash barrier complying with principles of the crash barrier of the present invention. The method may comprise horizontally sawing the conventional crash barrier and removing its upper portion, such that its lower portion (e.g., a stepped portion) remains attached to, or situated on, the ground or road to provide the base portion of the crash barrier. Cushioning channels may be then drilled in the lower portion (i.e., which thus becomes a base portion of the barrier) which may be filled with energy absorbing material. The lower base portion may be further sawed to include sectional cuts breaking the lower base portion into individual segments. Longitudinal cuts may be applied in perpendicular to the sectional cuts adapted to receive coupling plates used to interconnect adjacent base segments. A plurality of coupling rods are placed in the drilled cushioning channels and barrier beams, cables, and/or barrier modules (e.g., made of concrete, metal, wood or plastic) are then attached to the coupling rods, using any of the configurations described hereinabove and hereinbelow.

BRIEF DESCRIPTION OF THE DRAWINGS

The present invention is illustrated by way of example in the accompanying drawings, in which similar references consistently indicate similar elements and in which:

FIGS. 1A to 1G schematically illustrate possible embodiments of a crash burlier system of the present invention, wherein FIG. 1A shows a perspective view of the crash barrier in a resting state, FIG. 1B shows a sectional view of a possible base portion of the crash barrier, FIG. 1C shows a perspective top view of another possible embodiment of the base portion, FIG. 1D shows a cross section view of a cushioning channel in a base portion comprising an elastic element, FIG. 1E exemplifies an embodiment wherein the base portion of the crash barrier is stuck in asphalt layers, FIG. 1F shows a sectional view of a possible base and cushioning channel, and FIG. 1G illustrates an embodiment wherein the connecting rod is introduced into the ground or road;

FIGS. 1H to 1J schematically illustrate possible molds which may be used for onsite construction of the base portion employing cast-in-place methods, wherein FIGS. 1H and 1I exemplifies a step-shaped mold designed to form connecting shoulders having a connecting bore, and FIG. 1J exemplifies a possible mold designed to form generally rectangular stepped base segments having longitudinal connecting channels;

FIGS. 1K and 1L illustrates possible base and/or barrier portion structures, wherein FIG. 1K demonstrate a structure comprised of rectangular elements and FIG. 1L demonstrates a structure interconnected by mating shoulders;

FIG. 1M is a side view of a cast mold designed for casting base elements/segments configured to engage adjacent base elements by mating shoulders;

FIGS. 2A to 2C schematically illustrate the cushioning and impact absorbance effects of the safety crash barrier system of the present invention, wherein FIG. 2A is a perspective view exemplifying a displaced state of the crash barrier of the present invention after an incidental impact (hit), and FIGS. 2B and 2C respectively show side cross section views of a section of the crash barrier shown in FIG. 2A before (i.e., in resting state) and after (i.e., displaced state) such impact-contact;

FIGS. 3A and 3B schematically illustrate another possible embodiment of the crash barrier of the present invention employing cushioning means in the contact surfaces between adjacent barrier modules, wherein FIG. 3A is a perspective view of the crash barrier without the base section, and FIG. 3B is a perspective view of a possible embodiment of the cushioning elements;

FIGS. 4A to 4D schematically illustrate a yet another possible embodiment of the crash barrier of the present invention further employing horizontal bars for impact absorbance, wherein FIG. 4A is a front view of the crash barrier, FIG. 4B shows a possible embodiment of the horizontal bars, and FIGS. 4C and 4D schematically illustrates another possible embodiment employing U-shaped bars;

FIGS. 5A and 5B schematically illustrate still yet other possible embodiments of the crash barrier of the present invention employing a combination of concrete base portion and upper metallic beam barrier portion, wherein FIG. 5A is a perspective view of the crash barrier, and FIG. 5B is a perspective view of a base portion;

FIG. 6A shows general structure of the barrier, FIG. 6B demonstrates attachment of barrier modules or beams to the base section, and FIG. 6C demonstrates use of barrier cables and/or beams;

FIG. 7A shows a sectional side view of the conventional crash barrier to which a horizontal cut is applied, FIG. 7B shows a perspective view of the conventional barrier after applying the horizontal cut, removing its upper portion and applying sectional and longitudinal cuts, FIG. 7C shows the base portion after drilling cushioning channels and placing coupling rods thereinside, and FIG. 7D shows a perspective view of the converted crash barrier after placing barrier modules on the base portion;

FIGS. 8A to 8C schematically illustrate another crash barrier implementation of the present invention having barrier beams coupled to a base by coupling rods and cables connecting between pairs of adjacent rods, wherein FIG. 8A is a perspective view of the crash barrier implementation, FIG. 8B illustrates mounting a rod in a cushioning sleeve of the base, and FIG. 8C illustrates the connection between adjacent rods by the cable;

FIGS. 9A to 9C schematically illustrate impact absorbance of a crash barrier of the present invention comprising barrier beams coupled to a base by coupling rods, wherein FIG. 9A shows a sectional side view of the crash barrier before the impact, FIG. 9B shows a sectional side view of the crash view during the impact, and FIG. 9C shows a perspective view of the crash barrier after absorbing the impact.

Figures 1A, 1B, 1K, 1L:
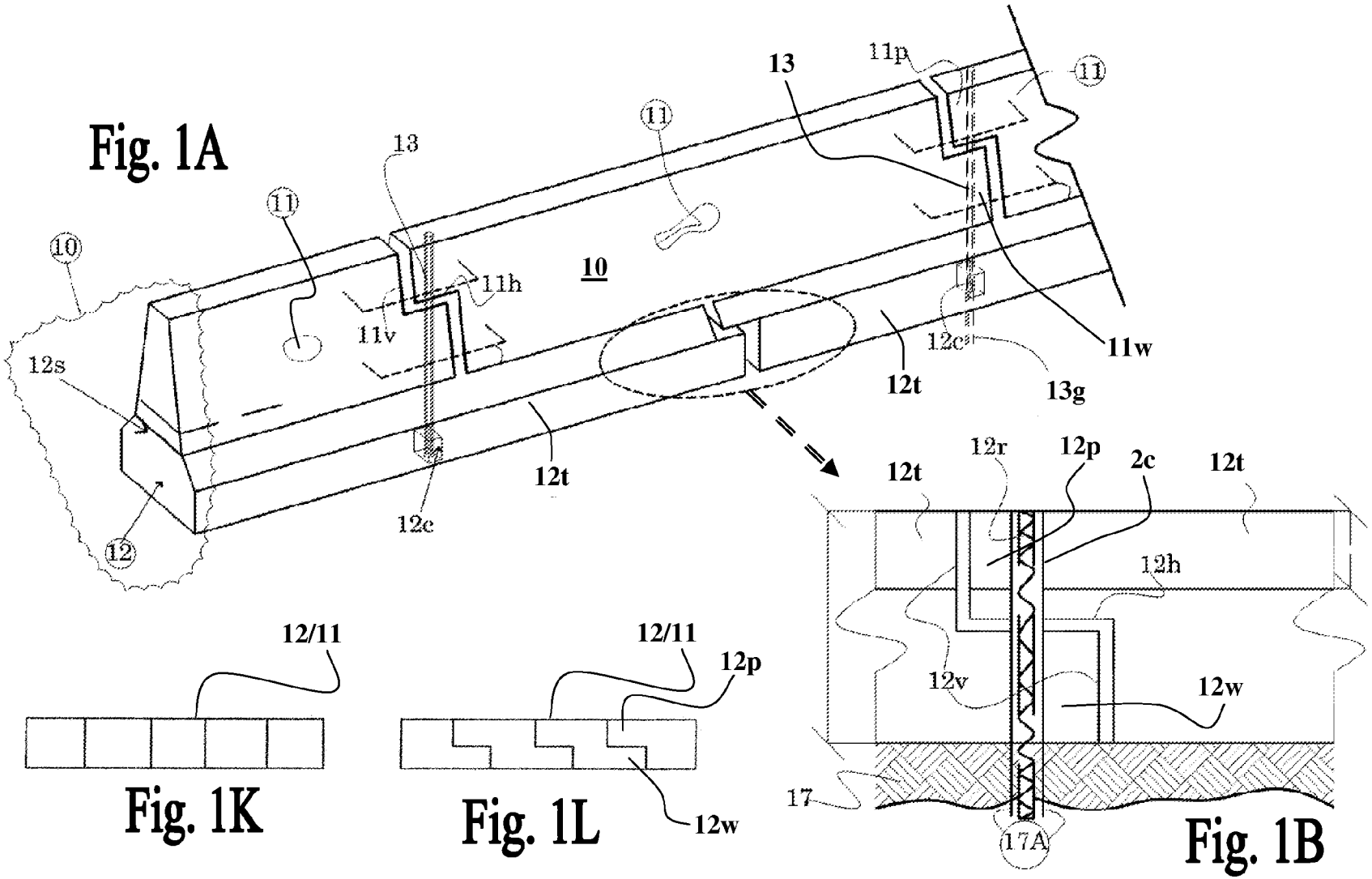

It is noted that the embodiments exemplified in the Figs. are not intended to be in scale and are in diagram form to facilitate ease of understanding and description.

DETAILED DESCRIPTION OF PREFERRED EMBODIMENTS

The present invention provides a safety crash barrier system with improved elasticity and/or flexibility properties. In general, the safety crash barrier of the present invention is horizontally divided to comprises an upper barrier portion flexibly and/or elastically coupled to a stationary, or semi-stationary, base portion. The coupling between the upper base portion and the base portion is such that the upper barrier portion can be flexibly and/or elastically moved relative to the base portion and absorb impact energy and thereby change its state from a resting state (i.e., before being hit by a colliding vehicle) into a displaced state (i.e., after being hit by the vehicle). In some embodiments the barrier modules are configured to at least partially restore back their resting state, such that the barrier modules being hit by a colliding vehicle may deflect the vehicle back to its lane.

The present invention also provides crash barriers designs which flexibility properties are enhanced by using a semi-stationary base portion which may flexibly move and absorb impact energy. For example, in some possible embodiments of the present invention the upper barrier portion is movably attached to the base portion by means of elastic and/or flexible elements, and the base portion is positioned on, or movably attached to, the ground or road surface (e.g., on, or stuck in, granular or asphalt layers). This configuration allows the upper barrier portion to move relative to the base portion and elastically and/or flexibly absorb impact energy, and restore back its original state after the collision, while allowing the lower base portion to move relative to the ground or road and flexibly absorb further impact energy.

The base and barrier portions of the safety crash barrier of the present invention may be implemented using substantially continuous and elongated elements, for example, made of concrete, plastic and/or metal. However, segmental construction of the base and/or barrier portions was found to be advantageous. For example, the base portion may be in form of elongated continuous cast-in-place rail (e.g., using a slip-form casting machine) and the barrier portion may be implemented using a plurality of barrier beams or modules movably and/or slidably attached to, or placed on, the base portion. While the plurality of barrier beams or modules may be interconnected, alternatively or additionally, they may be connected to the base portion by coupling rods as described herein above and below.

Some embodiments of the present invention relate to a safety crash barrier configuration employing solid barrier modules, designed to provide improved cushioning effects for absorbing impacts of incident vehicles. In these configurations the barrier portion of the safety crash barrier is comprised of a plurality of barrier modules situated on a base portion configured to define a skid surface allowing the barrier modules to slide thereon whenever they are being contacted by an incident vehicle. While the plurality of barrier modules situated on top of the base portion may be interconnected, alternatively or additionally, they are attached to the base portion by connecting rods. Optionally, the base portion of the safety crash barrier has a "stepped" configuration such as the Jersey barrier configuration, and its base and barrier modules are made from concrete, wood, cables plastic, metallic material or alloy, or combinations thereof.

While the base portion of the safety crash barrier of the present invention may be made from substantially long and continuous elements, in some embodiments a segmental base structure is utilized, wherein a horizontal longitudinal friction surface is defined between the lower base portion and the upper barrier portion. As elaborated below, this configuration allows dividing the collision impact of a colliding vehicle into a number of stages, and controlling the state of the crash barrier in each of the stages.

It is however noted that the present invention also provides safety crash barrier designs employing other materials and configurations, for example, in some embodiments of the present invention the base portion is made from concrete, recycled material, plastic, metallic material or alloy, or combinations thereof, and the upper barrier portion is made from elongated steel, wood, cable or plastic beams (e.g., corrugated sheet steel beams).

A. Modular Barrier

FIG. 1A schematically illustrates a safety crash barrier system 10 of the present invention according to one possible embodiment, comprising a base 12 portion, and a barrier portion implemented by a plurality of interconnected barrier modules 11 successively disposed on base 12. Optionally, base 12 may be made in a form of an elongated and substantially continuous base element, or alternatively, it may be structured from a plurality of interconnected base segments 12*t*.

FIGS. 1K and 1L illustrates possible base and/or barrier portion structure designs, wherein FIG. 1K demonstrate a structure comprised of rectangular elements and FIG. 1L demonstrates a structure interconnected by mating shoulders.

Base 12 is configured to define a skid surface 12*s*, (better seen in FIG. 2A), on which barrier modules 11 are slidably situated such that they can slide on it in response to impacts of colliding vehicles. Base 12 is preferably configured to have a faceted cross-sectional profile in order to provide a Jersey or "step" like configuration. According to some possible embodiments of the present invention the barrier modules 11 and base 12 are made of concrete.

The contact faces of adjacent barrier modules 11 may comprise mating vertical surfaces 11*v* and mating horizontal surfaces 11*h*, thereby defining an upper connecting shoulder 11*p* and a mating lower connecting shoulder 11*w*, formed in adjacent barrier modules 11. The connection between adjacent barrier modules 11 may be further facilitated by a coupling rod 13 disposed in a pass-through bore 11*c* (best seen in FIG. 4A) passing vertically through the connecting shoulders 11*p* and 11*w* of each pair of adjacent barrier modules, in perpendicular to their horizontal contacting surface 11*h*.

Various coupling techniques employing a coupling rod are demonstrated in U.S. Pat. No. 7,722,282, which is incorporated herein by reference, which may be similarly applied in the crash barrier modules of the present invention. Furthermore, the pass-through bore 11*c* in coupling shoulders 11*p* and 11*w* may be configured to provide some space to allow coupling rod 13 to move thereinside to increase the flexibility of the barrier structure.

Optionally, the lower end of coupling rod 13 is maintained in a cushioning channel 12*e* formed in base 12 which is configured to provide coupling rod 13 a limited degree of freedom to move back and forth and/or tilt thereinside. The confined movement and/or tilt of coupling rod 13 in cushioning channel 12*e* defines a cushioning range within which the upper barrier portion may be moved and absorb collision impacts, without encountering counter-resistance forces applied by coupling rod 13.

Additionally or alternatively, as best seen in FIG. 1G, the lower extremity 13*g* of coupling rod 13 may pass through cushioning channel 12*e* and penetrate into the ground 17 (or road 17*f*), which may be used as an energy absorbing element. This configuration allows the base segments 12*t* to move responsive to impacts against the resistance of the anchoring of coupling rod 13 in the ground (or road), and thereby provide further cushioning effect together with the friction movement of the barrier modules 11 over the skid surface 12*s*.

This configuration, using a connecting mechanism comprised of coupling rods 13 having a limited degree of freedom to move and/or tilt in the cushioning channels 12*e* in which they are disposed, provides barrier modules 11 some freedom to move on skid surface 12*s*, and thereby obtaining a cushioning effect. This barrier configuration adds flexibility to the barrier portion structure and thus improves cushioning effect and reduces the risks of injury to the passengers of a colliding vehicle, and also reduces damages to the colliding vehicle.

The length of barrier modules 11 may generally be about 3 to 8 meters, possibly about 4 to 6 meters, and their weight may generally be about 0.5 ton to 2 tons, possibly about 1.0 tons. The width of base 12 may generally be about 0.4 to 1 meters, possibly about 0.6 meters, and its skid surface 12*s* is adapted to provide a friction coefficient of about 0.1 to 0.5. The height of skid surface 12*s* above the ground (or road) surface may generally be about 35 to 65 cm, optionally about 45 cm. The width of skid surface 12*s* may generally be about 10 to 50 cm, possibly about 25 cm.

while continuous cast-in-place techniques may be employed in fabricating the base and/or barrier portions, segmental configurations of the barrier portions of the present invention may advantageously be fabricated employing pre-cast techniques e.g., using reusable molds. Typically, in such pre-cast techniques the segments of the base and/or barrier portions are fabricated in a factory and then shipped to the crash barrier installation site and assembled in place.

The upper surface of base 12 may be finely processed and smoothed in order to reduce its friction properties. For example, one or more smoothing layers like polished concrete or sprayed silicon may be applied to reduce friction properties of skid surface 12*s*. Additionally or alternatively, skid surface 12*s* may be covered by a lubricant layer (e.g., lubricant grease), or by a plastic layer (e.g., Polyethylene). Further, additionally or alternatively, the barrier modules 11 may be fabricated utilizing pre-cat molds having finely smoothed, and/or lubricated, bottom surfaces designed to further reduce the friction coefficient.

Figure 10:
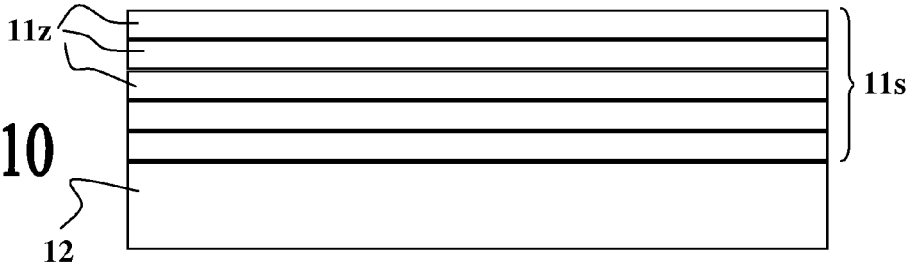
FIG. 10 schematically illustrates a possible embodiment of the present invention wherein the upper barrier portion comprises a plurality of barrier elements placed one on top of the other.

With reference to FIG. 10, crash barrier implementations of the present invention may comprise a structure 11*s* comprising a plurality of barrier portions 11*z* disposed in a rest state one above the other and coupled to the base portion 12. The structure of barrier portions 11*s* may be configured to slide over the base portion 12 in response to impact of a colliding vehicle, and each of the plurality of barrier portions 11*z* may be configured to horizontally slide one relative to other in response to the impact, to thereby absorb the impact energy of the collision. A coupling rod may be used to couple the plurality upper barrier portions structure to the base using any of the methods described hereinabove and hereinbelow.

B. Base Portion

FIG. 1B exemplifies one possible embodiment of base 12 of safety crash barrier system 10 wherein the base is comprised from a plurality of interconnected base segments 12*t*. In this example the connection between adjacent base segments 12*t* is obtained by connecting an upper shoulder 12*p* and a lower shoulder 12*w* of adjacent base segments 12*t*. Upper shoulder 12*p* and lower shoulder 12*w* of base segments 12*t* may be more or less similar in shape (but not is size) to shoulders of barrier modules described above with reference to FIG. 1A.

A coupling stake 12*r* may be placed in a connecting bore 2*c* vertically passing through connecting shoulders 12*p* and 12*w*. Connecting bore 2*c* may be designed to provide base segments 12*t* some freedom to move about coupling stake 12*r*, and thereby to add flexibility to the base structure. The lower end of coupling stake 12*r* may be introduced into the ground 17 in order to limit the movement of the base segments 12*t* and reduce breakthrough of base 12. Optionally, a receiving pipe 17A may be placed in the ground 17 (or road) configured to receive a lower end section of coupling stake 12*r*. Elasticity may be added to the base structure by cushioning connecting bore 2*c* with elastic elements or materials (e.g., spring, rubber, and suchlike).

Alternatively, the base 12 may be firmly anchored to the ground 17 (or road), or to connecting stakes 12*r*, to prevent movement thereof, for example, by placing receiving pipes 17A in the ground or road configured to provide a firm anchor to coupling stakes 12*r*. In yet another alternative embodiment, exemplified in FIG. 1E, the base portion 12 of the crash barrier 10 is held by placing it in one or more asphalt layers 17*f* of the road. In such possible embodiments base segments 12*t* may be substantially anchored to the asphalt layers 17*f* of the road with some degree of flexibility to move against it in response to strong impacts, and to stop the vehicle to thereby provide the minimum working width (W value) needed.

FIG. 1C demonstrates a simplified configuration of a base portion 12 without coupling rods or stakes. In this embodiment the base segment 12 are placed on the ground or road without anchoring stakes, thereby adding more flexibility to the structure. Connection between the base segments is obtained through the friction forces between upper shoulder 12*p* and a lower shoulder 12*w* of adjacent base segments. In this configuration there are no cushioning channels in the base portion 12, such that the interconnected barrier modules are slidably place on top of base 12 without using connecting rods. Furthermore, substantial grip of the base segments 12 to the ground or road is obtained due to their mass and due to the weight of the barrier modules situated on their skid surfaces 12*s*. Additionally, the barrier modules in this embodiment may be interconnected using horizontal and/or U-shaped bars, as described below with reference to FIGS. 4A-4D.

With reference to FIG. 1F, cushioning channels 12*c* may comprise an energy absorbing material 12*f* (e.g., Neopran, rubber), or element (e.g., spring), or any suitable material capable of adding elasticity to the grip of coupling rods 13 in cushioning channels 12*c*. This configuration allows coupling rods 13 to be elastically moved or tilted back and forth and sideways in case of impacts, and restore their original state thereafter. In these way barrier modules 11 can be elastically moved on skid surface 12*s*, absorb impacts of incident vehicles, and return back to place after the incident car deflects back to the traffic lane. This configuration adds elasticity to the barrier structure and consequently reduces the ASI index.

FIG. 1D demonstrates another possible embodiment wherein the lower end of coupling rod 13 is maintained between two leaf springs 7*s* provided in cushioning channel 12*c* of base 12, adapted to elastically hold coupling rod 13 in cushioning channel 12*c* while allowing it to elastically absorb energy transferred to coupling rod 13 in response to an impact of a colliding vehicle. Leaf springs 7*s* are configured to apply forces that elastically resist the movement of coupling rod 13, allowing it to return coupling rod 13 after an impact back to its original state and restore back the state of the barrier modules 11 attached to it.

Adding elastic elements and/or materials (e.g., springs, rubber, and suchlike) in cushioning channels 12*c* and/or connecting bores 2*c* may define elastic and flexible impact absorbance ranges. For example, if elastic elements and/or materials are used, elastic impact absorbance range may be defined within the range in which the coupling rods 13 can elastically move or tilt before contacting the edges of the cushioning channels 12*c*. Thereafter, if the incident car does not return to its lane or halt, the flexible impact absorbance range starts as the coupling rods 13 starts to deform until the movement of the incident vehicle is stopped.

Coupling rods 13 may be fabricated from a solid cylindrical rod made from a deformable (flexible or semiflexible) or elastic material, such as steel or other metallic material or alloy, for example, having a diameter generally in the range of 1.6 to 3 cm, optionally about 2 cm.

Of course coupling rod 13 may be configured in other cross-sectional shapes (e.g., triangular, rectangular, hexagonal, and the like). Alternatively, coupling rod 13 may be fabricated from a material having elastic or resilient properties. Optionally, coupling rod is a solid steel bar located within a cylindrical connecting pass-through bore 11*c* having a diameter of about 30 mm, as illustrated in FIG. 4A. It is noted that coupling rod 13 is optionally not bonded to the cushioning channel 12*c*, such that it may move freely thereinside. Additional energy absorbance may be obtained by filling pass-through bore 11*c* in which coupling rod 13 is disposed with energy absorbing material, and/or by using a cup and spring configuration at the upper end of coupling rod 13, for example, as described in details in U.S. Pat. No. 7,722,282.

FIG. 1H schematically illustrates a side view of a step-shaped mold 35 that may be used to construct a segmented base portion for the crash barrier of the present invention using a cast-in-place technique. Mold 35 comprises a partitioning surfaces/part 33 configured to act as a separating element between adjacent molded base segments and form their mating shoulders (e.g., 12*p* and 12*w* depicted in FIGS. 1B and 1C), and a vertical sleeve 34 designed to form the connecting bore 2*c* passing through the mating shoulders. The partitioning part 33 may be made from steel, plastic or recycled material (e.g., rubber, Neopran, recycled materials/tiers), and its vertical faces may comprise one or more layers of energy absorbing material (e.g., rubber, Neopran). FIG. 1I schematically illustrates adjacent base cast-in-place base segments 12 fabricated with mold 35. Partitioning surfaces 33 of mold 35 placed before casting the barrier modules 12 may be made from polystyrene, steel, plastic, recycled materials, or combinations thereof, and sleeve 34 may be made from a metallic (e.g., steel), or plastic, pipe.

Figure 7A:
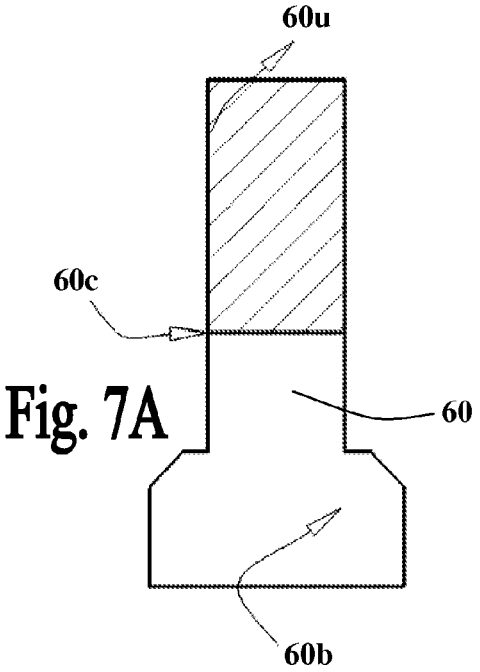
FIGS. 7A to 7D schematically illustrate a method of converting conventional cast-in-place concrete barriers into a crash barrier complying with the principles of the present invention, where
Figure 7C:
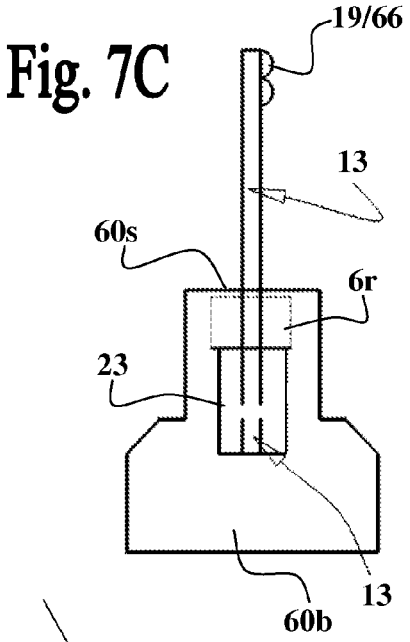
Figure 7B:
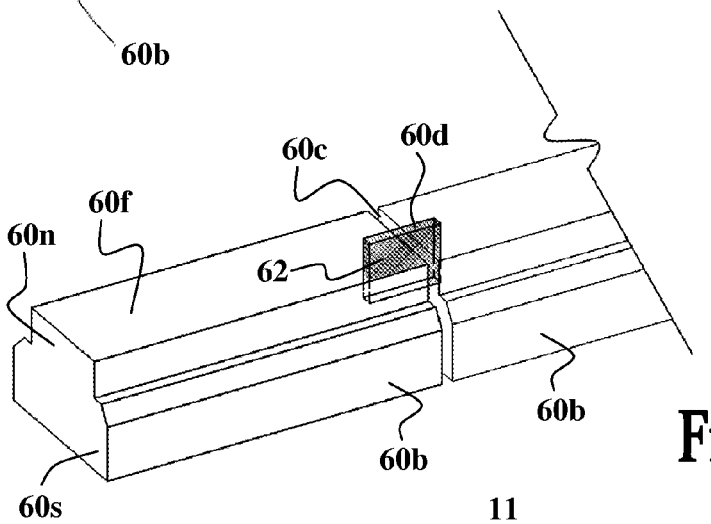
Figure 7D:
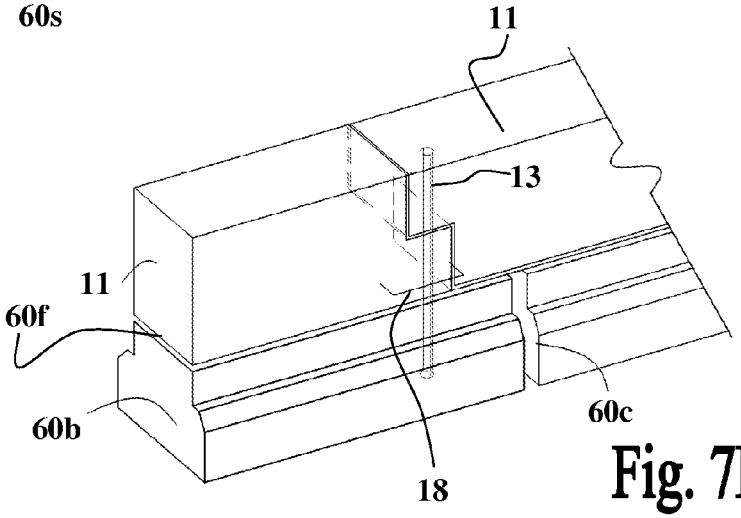

FIG. 1J exemplifies a possible mold 80 designed to form generally rectangular stepped (e.g., having a slanted step 88) base segments having longitudinal connecting channels (e.g., 60*d* shown in FIG. 7B). Mold 80 is designed for constructing base segments having flat side faces, such as shown in FIGS. 1K and 7B. Mold 80 includes two elongated stepped panels 81 having two side partitions 82 forming a mold enclosure which may be filled (e.g., with concrete) via an upper opening, as illustrated by arrow 84. Each side partition 82 may include one or two mold-ribs 83 centrally attached to its upper portion, to form a connecting channel (60*d*) adapted to receive a coupling plate (e.g., 62, in FIG. 7B). Mold-ribs 83 may be made from a material that may be easily melt out or removed (e.g., polystyrene) for placing the coupling plates.

FIG. 1M exemplifies yet another possible mold 80*a* suitable for casting a base segment structure using the step-shaped mold 35 (see FIGS. 1H and 1I) at the sides of the mold 80*a*. Mold 80*a* is designed for constructing base segments having mating shoulders (e.g., 12*p* and 12*w* depicted in FIGS. 1B and 1C) at side faces, such as shown in FIGS. 1L and 1B. Mold 80*a* includes two elongated stepped panels 81 having two side step-shaped molds 35 forming a mold enclosure which may be filled (e.g., with concrete) via an upper opening, as illustrated by arrow 84. Each step-shaped mold 35 may include one or more layers of energy absorbing material applied over its vertical faces (i.e., facing the vertical face 12*v* of the mating shoulders), and a vertical sleeve 34 for forming the connecting bores (2*c*) in the mating shoulders.

C. Impact Absorbance

FIGS. 2A to 2C exemplify the cushioning effect and crash absorbance effects of the safety crash barrier system 10 of the present invention. FIG. 2B shows a side view of the crash barrier before it is hit by the colliding vehicle, and FIG. 2C shows the same side view after vehicle impact. When barrier modules 11 are being hit by an incident vehicle (designated by arrow 3*w*) the energy of the impact is absorbed by the system in a two or more stages process:

i) Cushioning effect: in the first stage the barrier modules 11 receiving the impact slides (typically short slide of about 1 to 5 cm) over skid surface 12*s* on the upper surface of the base 12. Impact energy is absorbed as the barrier modules 11 move on skid surface 12*s* against friction between the barrier modules 11 and base 12.

ii) In embodiments in which base 12 is constructed from base segments 12*t*, some of the collision energy in this stage may be also absorbed by the base segments 12*t* "meeting" the wheel of the vehicle. More particularly, the base segments 12*t* may also move responsive to the impact and absorb further impact energy.

iii) Correspondingly, coupling rod 13 is forced to move and/or tilt in the same direction of the impact (3*w*) thereby pressing the energy absorbing material (or element) filling the cushioning channel 12*c*, as shown in FIG. 2A, until the movement or tilt of coupling rod 13 is stopped (due to the elastic materials provided in cushioning channel 12*c* and/or due to reaching the boundaries of cushioning channel 12*c*);

iv) If the colliding vehicle is not deflected back to its lane or stopped during stages i), ii) or iii), coupling rod 13 becomes a flexible stopper that may flexibly deform to some extent to further absorb impact energy, but at the same time prevent further sliding of barrier modules 11 in order to bring the colliding vehicle to rest and prevent the car from crossing the central reserve and reaching the opposite lane or falling into a side chasm or channel.

v) In embodiments employing a segmented base, if the rear part of the colliding vehicle hits the base 12 of the barrier, the interconnected segments 12*t* (see FIG. 1B) absorb the impact energy, which further reduce the ASI index of the crash barrier.

As exemplified in FIGS. 2B and 2C the crash barrier may include a stopper element 29 vertically protruding from the upper surface of the base portion 12, and configured to be received inside a cavity 28 formed on the underside of the barrier module 11 (i.e., in the surface of the barrier module interfacing with the base portion) placed over the upper surface of the base 12. As exemplified in FIG. 2C, as the state of the crash barrier is changed from its resting state into a displaced state, the barrier module 11 absorbing the impact energy of the colliding vehicle absorbs the collision energy and slides over the base portion 12 until a margin 28*m* of the cavity 28 abuts the stopper elements. Stopper element 29 may be manufactured from a material having sufficient strength to resist and possibly even stop movement of the barrier module. Optionally, stopper element 29 may be manufactured form a flexible or elastic/resilient material (e.g., steel rod) which lower portion is embedded into the base 12 (e.g., during a casting process).

D. Triangular Prism Cushioning Means

FIGS. 3A and 3B schematically illustrate another possible embodiment of the crash barrier employing cushioning means 15 attached in the contact surfaces between adjacent barrier modules 11'. In this embodiment a facet 2*f* is formed in the vertical contact surfaces of the upper and lower connecting shoulders, 11*p'* and 11*w'* respectively, of barrier modules 11' which thus defines a sector space between the vertical surfaces of adjacent barrier modules 11', in which cushioning means 15 is attached. If barrier modules 11' are contacted by a colliding vehicle causing barrier modules 11' to slide on the skid surface as exemplified in FIG. 2A, such that the cushioning means 15 are sandwiched between the facets 2*f* and surfaces 2*g*, as they are forced to move one towards the other. In this way further cushioning is obtained allowing the barrier modules 11' to move and better absorb impact energy.

Cushioning means 15 are optionally made from an elastic material, such Neopran or rubber.

As shown in FIG. 3B cushioning means 15 may be implemented by a polymer triangular prisms having a maximum thickness of about 4 to 5 cm, which is attached between adjacent barrier modules, as show in FIG. 3A. Optionally, the cushioning means 15 are bonded to the contact surfaces of the barrier modules.

E. Horizontal Connecting Bars

FIGS. 4A and 4B schematically illustrate a possible embodiment of the invention employing horizontal bars 18 passing in perpendicular to the vertical surfaces 11*v* of interconnected barrier modules 11, or being attached by their extremities 18*e* over the contact side surfaces (e.g., 11*v* in FIG. 1A) of adjacent modules 11. Horizontal bars 18 may be fabricated from a deformable material designed to improve energy absorbance, or alternatively, from material having elastic and or resilient characteristics. FIG. 4B exemplifies one possible embodiment of horizontal bars 18 having hook-shaped extremities 18*e* designed to be introduced into sockets (not shown) formed in the barrier modules 11. Optionally, horizontal bars 18 are steel bars having a diameter of about 12 to 16 mm and a length of about 1 meter. Yet optionally, horizontal bars 18 can move with the bather modules and mechanically behave as cables attaching adjacent barrier modules. Optionally, horizontal bars 18 can be installed inside the barrier modules e.g., before casting together with other steel rods or cables needed according codes or calculations (e.g., in cast in place process).

Figure 4C:
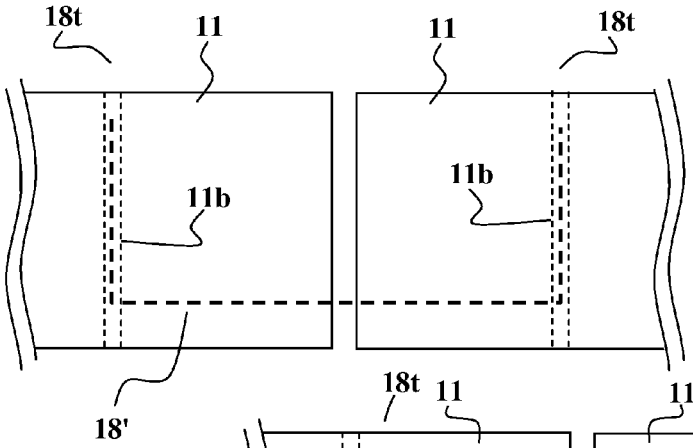
Figure 4D:
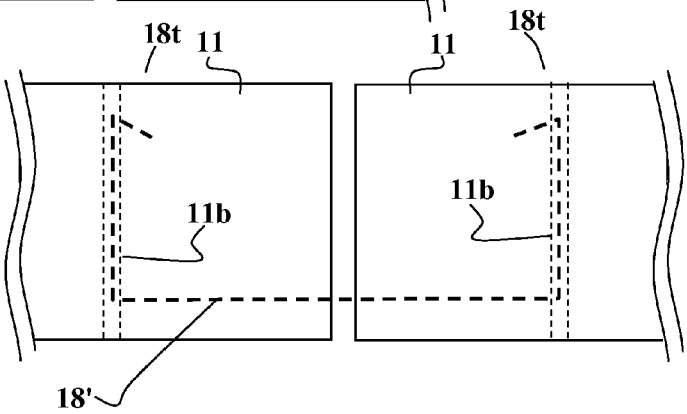

FIGS. 4C and 4D schematically illustrates a possible embodiment employing fastening U-shaped bars 18' embedded inside (e.g., in a cast process) the body of the barrier modules 11 and optionally designed to pass through lateral bores 11*b* passing through the width of the barrier modules 11. As exemplified in FIG. 4D the arms of U-shaped bars 18' may pass through lateral bores 11*b* and their tips 18*t* may have a bent configuration inside the body of the barrier modules 11 in order to achieve a firm grip between the barrier modules 11 and the U-shaped bars 18'.

F. Barrier Beams

Figure 5A:
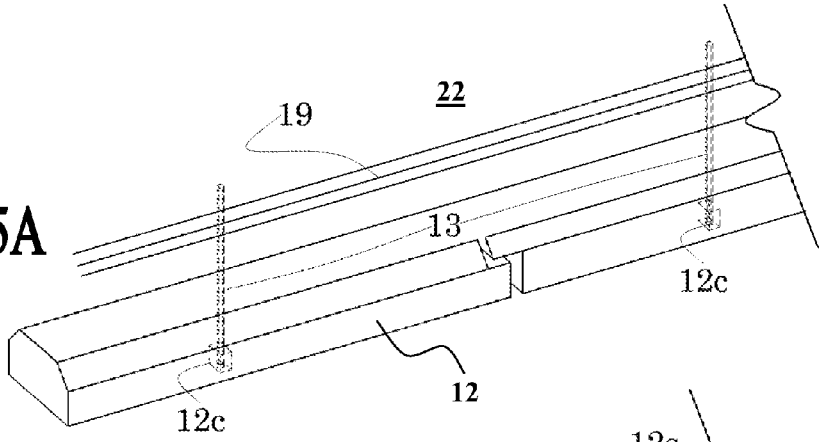
Figure 5B:
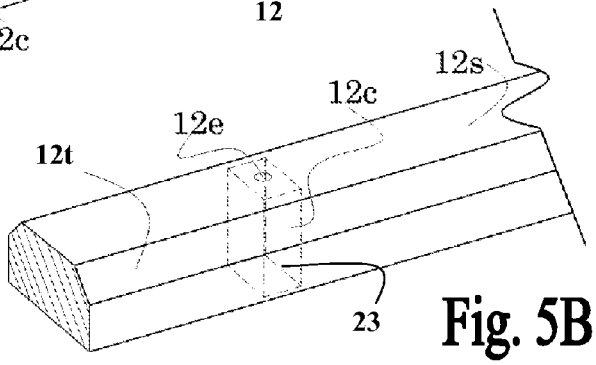

FIGS. 5A and 5B schematically illustrate another possible embodiment of a crash barrier 22 of the present invention employing barrier beams 19 (e.g., metallic, wood/cables, recycled materials or plastic) fixedly attached to coupling rods 13. In this embodiment the safety crash barrier 22 also comprises a base 12 having cushioning channels 12*c* designed to receive and hold coupling rods 13, having substantially similar configurations as described hereinabove with reference to FIG. 1.

Base 12 advantageously designed to provide a stepped configuration, and may be fabricated as an elongated and substantially continuous base element, or alternatively, it may be assembled from a plurality of interconnected base segments 12*t*, as described hereinabove.

Barrier beams 19 may be implemented by means of standard elongated metal beam barriers, made of steel (e.g., corrugated galvanized steel beams) for example, or from wood or cables. This preferred embodiment can still provide a four to five stages impact absorbance process as described hereinabove, wherein a cushioning effect is obtained by movement/tilt of the coupling rod 13 against the energy absorbing material filling the cushioning channels 12*c*. Further cushioning is obtained due to the flexible impact absorbance properties of the metallic barrier beams 19. Typically, the colliding vehicle is stopped by the metallic barrier beams 19, as in standard metal barriers, but with enhanced flexibility obtained due to the movability of the coupling rods 13 and base segments 12*t* which allows crash barrier 22 to absorb more impact energy.

As seen, the base 12 provides a Jersey type stepped configuration (e.g., new jersey configuration) such that the colliding vehicle may be deflected back to its lane during the first stage of the energy absorbance process responsive to the cushioning effect. This embodiment also advantageous as it combines the enhanced flexibility properties of the concrete base segments 12*t*, elasticity and flexibility of the coupling rods 13, with the strength and elasticity properties of conventional metallic (e.g., steel) beam or cable barriers, which may be especially effective for the side of a road lane.

FIG. 5B illustrates a base segment 12*t* comprising a cushioning channel 12*c* filled with an energy absorbing material 23 having a hole 12*e* designed to receive the end portion of a coupling rod 13.

G. Elevated Skid Surface

Figure 6A:
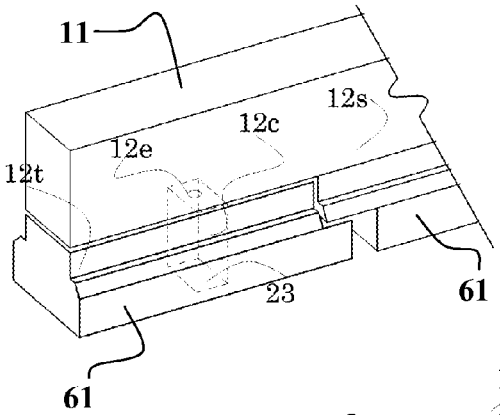
FIGS. 6A to 6C schematically illustrate possible embodiments of the crash barrier of the present invention having a skid surface situated above the stepped section of the base portion, where
Figure 6B:
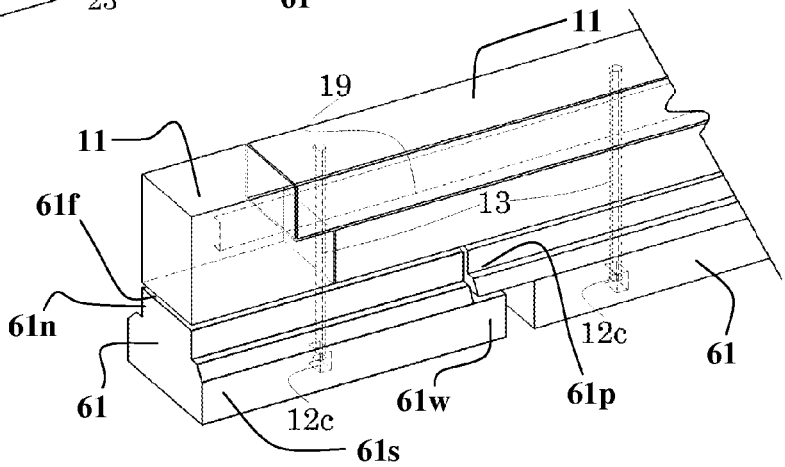
Figure 6C:
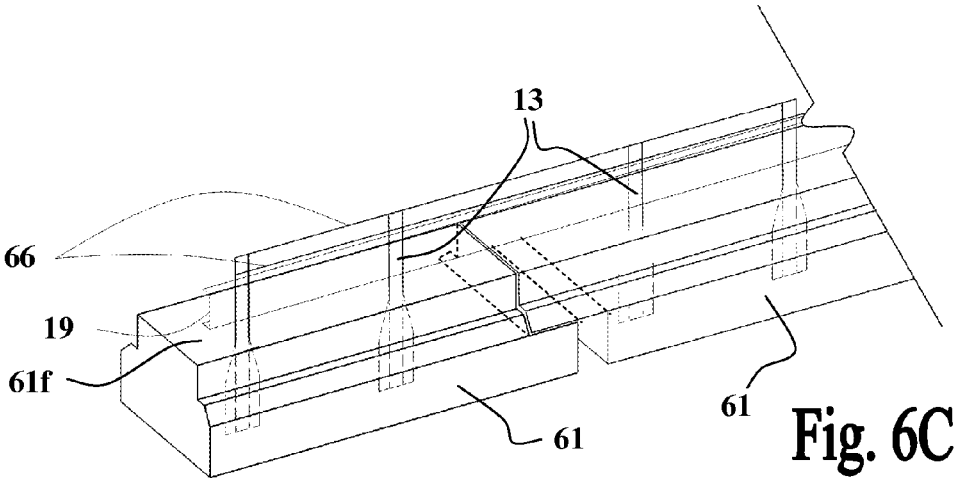

FIGS. 6A to 6C schematically illustrate possible embodiments of the crash barrier of the present invention having a skid surface 61*f* situated above the stepped section of the base portion 61. As seen, in this embodiment the segmented base portion 61 includes a lower waist section 61*s*, and an upper neck section 61*n* having a flat upper surface defining the skid surface 61*f* of base portion 61. In this embodiment the skid surface 61*f* is elevated above the waist section 61*s* defining the step of the base portion 61. The inventor hereof discovered that ASI values of the crash barrier can be significantly reduced by having the skid 61*f* surface elevated above the barrier step, for example, by setting the height of the skid surface 61*f* to about 35 cm above the ground or road surface. The height of waist section 61*s* may generally be in the range of 5 to 30 cm.

FIG. 6B schematically illustrates placing on base portion 61 barrier modules 11 (or attaching metallic beams 19—shown in broken lines), as described hereinabove with reference to FIGS. 1 and 5. FIG. 6C further demonstrates using cables 66 (e.g., steel barrier cables) attached to coupling rods 13. Though two cables 66 are shown in FIG. 6C, more or less such cables may be employed. FIG. 6C further illustrates a barrier beam 19 attached to coupling rods 13, however, obviously, it is not essential to use both cables 66 and barrier beams 19 in the crash barrier of the present invention.

FIGS. 8A to 8C schematically illustrate another crash barrier implementation 80 of the present invention comprising barrier beams 19 coupled along the length of the base 61 by coupling rods 13, and also comprising cables 66 connecting between pairs of adjacent rods 13. The base section 61 of crash barrier 80 is substantially similar to the base section 61 described hereinabove with reference to FIGS. 6A to 6B. As demonstrated in FIG. 8B, in this implementation the coupling rods 13 may be coupled to the base 61 by cushioning sleeves 87 disposed in the spaced apart relationship in base 61. The height 87*h* of the cushioning sleeves 87 may more or less equal to the height 86*h* of the base 61.

The base 61 may be a type of cast-in-place or precast base, slidably, or fixedly, attached to the ground or road surface. In possible embodiments of the present invention the base 61 comprises a plurality of interconnected base sections. For example, adjacent base sections may be coupled to each other by coupling shoulders 61*s*. The coupling rods 13 may pass through the base and introduced into the ground or road, as described hereinabove. Optionally, cushioning spacers 81 (e.g., made of energy absorbing material such as plastic or rubber) are interposed between interfacing faces of adjacent base sections. For example, the cushioning spacer 81 may be attached to one or more faces of the coupling shoulders 61*s*. Optionally, the cable 66 is coupled to all of the coupling rods 13.

FIGS. 9A to 9C schematically illustrate impact absorbance of a crash barrier of the present invention comprising barrier beams 19 coupled to a base 61 by coupling rods 13. FIG. 9A shows a sectional side view of the crash barrier before the impact 91 and FIG. 9B shows a sectional side view of the crash view during the impact 92 wherein the coupling rods absorb the impact 92 and tilt or even deform due to the impact. As demonstrated in FIG. 9C, showing a perspective view of the crash barrier after absorbing the impact, the barrier beam 19 may be deformed as it absorbs portions of the impact, and the interconnected sections of the base 61 may be displaced one relative to the other as the base of the crash barrier absorbs portions of the impact, thereby further improving the ASI index of the barrier.

As exemplified in FIG. 9A, the crash barrier may, additionally or alternatively, comprise an inverted "U"-shaped beam 85 placed on top of the coupling rods 13, such that the upper end portions of the rods 13 are enclosed inside the channel 85*c* formed by the "U"-shaped configuration of the beam 85. Possible embodiments of the present invention may further include connecting cables, as described hereinabove, connecting between pairs of adjacent rods, or between a plurality, or all, of the rods, as may be required.

The overall height of the base of the crash barrier may generally be in the range of 40 to 60 cm, however, possible embodiments of the present invention may be configured to have greater, or smaller, height, as the case may be.

H. Conversion of Conventional Crash Barriers

FIGS. 7A to 7D schematically illustrate a method of converting a conventional cast-in-place concrete barrier 60 into a crash barrier complying with principles of the present invention by sawing and removing the upper portion 60*u* of the barrier 60. As shown, the cut 60*c* is optionally made above the stepped portion of the base 60*b*, in order to provide elevated skid surface 60*f*. The cut surface may be polished and/or lubricated as described above, in order to reduce the friction coefficient of skid surface 60*f*. Vertical drills 6*r* (shown in FIG. 7C) may be made in base 60*b* defining cushioning channels adapted to receive the coupling rods 13. Drills 6*r* may be filled with an energy absorbing material 23 (or element) for adding elasticity, as described hereinabove.

As seen in FIG. 7B, sectional cuts 60*c* may be sawed in base 60*b* to define a segmented base for the crash barrier. The segments of the sectionally sawed base 60*b* may be connected by placing short coupling (e.g., metallic) plates 62 in longitudinal cuts 60*d* drilled in base 60*b* in perpendicular to sectional cuts 60*c*. Coupling plates 62 configured to resist to some extent movement of base segments responsive to incidental contacts, and to deform in cases where the incident vehicle does not deflect back to its lane. FIG. 7C exemplifies attachment of cables 66 or metallic (or plastic) barrier beams 19 to coupling rods 13 attached to base 60*b*, and FIG. 7D exemplifies attachment of barrier modules 11 placed over the skid surface 60*f*.

It is noted that the crash barrier of the present invention is designed to provide a barrier system having energy absorbance and ASI properties similar to those obtained with conventional metal beam barriers but which is significantly easier and more convenient to maintain and repair, and having substantially longer life span. The crash barrier of the present invention is much easier to repair and maintain since it simply requires replacing barrier modules, without metal cutting and adjusting, as required with conventional metallic barrier beams.

It is further noted that the base and or barrier portion(s) of the crash barrier of the present invention may be implemented without mating shoulders e.g., having flat side surfaces. In such possible embodiments the barrier modules may be interconnected using horizontal and/or U-shaped bars, as described hereinabove.

I. EXAMPLES

The following results have been obtained from computational simulations carried out for various segmented configurations of concrete crash barriers of the present invention, such as illustrated in FIGS. 1, 2 and 6. The following parameters have been considered in the simulations performed:

A) Skid Plane Height ($h_{cut}$): two alternatives were tested—

I) Skid surface height of 20 cm above the ground (or road), i.e., locating the skid surface between the upper two slopped surfaces S1 and S2, as best seen in FIG. 1E.

II) Skid surface height of 35 cm above the ground (or road), i.e., approximately at the center of gravity e.g., as exemplified in FIGS. 6A and 6B.

B) Installation Conditions: the following parameters were considered—

I) The base portion of the safety crash barrier is fixedly anchored to the ground or road (e.g., using cast-in-place techniques).

II) the base portion of the safety crash barrier is movably placed on the ground or road (e.g., using pre-cast techniques) with friction coefficient assumed to be about μ=0.5 (according to DIN 4141 for material concrete-concrete).

III) The coefficient of friction between the base and the barrier modules was fixed to be μ=0.3.

IV) The coefficient of friction between the car and the concrete barrier assumed to be μ[−]=0.15.

C) Connecting rod:

I) a 20 mm steel bar element, wherein the bar is not bonded to the pass-through bore, thus allowing the bar to move within a 40×25 mm bore.

II) A 30 mm steel bar element, wherein the bar is free to move within a 50×35 mm pass-through bore.

J. Results

The results obtained in the computational simulation are summarized in the table below.

| | Configuration | | | | ASI |
|---|---|---|---|---|---|
| System | M [—] | $d_{Pin}$ [mm] | $h_{cut}$ [mm] | Base | (maximal) |
| TB11 - stiffer car | 0.15 | 30 | 200 | fixed | 1.48 |
| TB11 - stiffer car | 0.15 | 30 | 350 | fixed | 1.80 |
| TB11 - stiffer car | 0.15 | 20 | 350 | movable | 1.24 |
| TB11 - less stiff | 0.15 | 30 | 350 | movable | 0.87 |

Note:
ASI values determined for fixed cast-in-place barriers with crash test dummies are typically about 1.6, and it is therefore reasonably expected that the ASI values of the safety crash barrier of the present invention be smaller than the ASI values listed in the above table.

K. Conclusions

The above table lists the ASI-values results obtained for the various configurations. It is noted that the vehicles being used in real full-scale impact-tests significantly differ with regard to their characteristics, in particular in terms of the stiffness of the car front and their crash zone. The simulations carried out here show the different effects that the results do indeed show enormous effect on the obtained ASI-value.

The obtained results also clearly indicate that:

Fixedly anchoring to the base portion to the ground or road results in higher ASI-values.

Increasing the height of the skid surface with a fixedly anchored base portion has a negative effect on the ASI-values.

Using movably situated base segments with the skid surface of the present invention can sharply reduce ASI-values.

All of the abovementioned parameters are given by way of example only, and may be changed in accordance with the differing requirements of the various embodiments of the present invention. Thus, the abovementioned parameters should not be construed as limiting the scope of the present invention in any way. In addition, it is to be appreciated that the different rods, bars and channels, and other members, described hereinabove may be constructed in different shapes (e.g. having oval, square etc. form in plan view) and sizes differing from those exemplified in the preceding description.

The above examples and description have of course been provided only for the purpose of illustration, and are not intended to limit the invention in any way. As will be appreciated by the skilled person, the invention can be carried out in a great variety of ways, employing more than one technique from those described above, all without exceeding the scope of the invention.

The invention claimed is:

1. A safety crash barrier comprising:

a) an elongated base portion placed on a road section or ground and comprising a plurality of base segments coupled to each other and having a plurality of spaced apart cushioning channels, said base segments being movable relative said ground or road for absorbing impact energy of a colliding vehicle contacting said crash barrier;

b) a plurality of coupling rods, each disposed in one of said cushioning channels of the base portion and vertically protruding therefrom with some predefined freedom to move or tilt therein relative to said base portion; and c) a plurality of barrier elements movably disposed over said base portion and said base portion by said coupling rods, thereby allowing changing one or more of said barrier elements into a displaced state in which said one or more barrier elements contacted by the colliding vehicle are caused to move relative to said base portion and absorb more impact energy imparted by said vehicle, and to thereby substantially stop or deflect movement of said vehicle.

2. A safety crash barrier according to claim 1, wherein the plurality of barrier elements are configured and operable to at least partially restore back to a state prior to being changed into the displaced state, so as to deflect the colliding vehicle.

3. A safety crash barrier according to claim 1, wherein the plurality of barrier elements are interconnected.

4. A safety crash barrier according to claim 1, wherein at least some of the cushioning channels provided in the base portion comprises elastic elements configured to elastically absorb movements or tilts of the coupling rods placed therein.

5. A safety crash barrier according to claim 4, wherein the elastic elements comprise one of the following: spring elements, rubber elements, Neopran or other energy absorbing material elements, or a combination thereof.

6. A safety crash barrier according to claim 1, wherein the barrier elements comprise elongated beam or cable elements coupled to the base portion by the coupling rods.

7. The safety crash barrier according to claim 1, wherein the base portion has a roughened upper surface defining a friction surface.

8. A safety crash barrier according to claim 1, wherein the barrier elements are positioned on top and along a length of the base portion, and wherein adjacently located barrier modules are interconnected by one of the plurality of coupling rods.

9. The safety crash barrier according to claim 8, wherein the base portion has a smoothed upper surface configured to reduce the friction between the barrier modules and said base portion to thereby define a skid surface on which the barrier modules are slidably situated.

10. The safety crash barrier according to claim 8, wherein lower faces of the barrier modules have a smooth surface configured to reduce the friction between said barrier modules and the base portion.

11. A safety crash barrier according to claim 8, wherein said adjacently located barrier modules are coupled to each other by said mating shoulders, having bores defining a pass-through bore configured to interconnect said adjacently located barrier modules by one of the plurality of coupling rods passed therethrough.

12. A safety crash barrier according to claim 1, wherein extremities of each base segment comprises at least one mating shoulder configured to movably engage with a mating shoulder of an adjacently located base segment.

13. A safety crash barrier according to claim 12, wherein the base segments are movably placed on the ground or on a road, or fixedly anchored to the ground or the road.

14. A safety crash barrier according to claim 12 comprising a bores passing through the base segments, said bores configured to receive a coupling stake or one of the coupling rods to be introduced into one of: the ground, a road, or a pipe placed in said ground or said road.

15. A safety crash barrier according to claim 14, wherein the connecting bore is filled with an energy absorbing material.

16. A safety crash barrier according to claim 8, wherein the plurality of barrier elements are interconnected by horizontal or U-shaped bars.

17. A method of constructing a crash barrier at a barrier site, comprising:

a) placing an elongated base on a road section or ground at said barrier site, said elongated base having a plurality of spaced apart cushioning channels and comprising a plurality of base segments coupled to each other and being movable relative said ground or road for absorbing impact energy of a colliding vehicle contacting said crash barrier;

b) placing coupling rods in said cushioning channels of said elongated base such that the coupling rods vertically protrude from the base with some freedom to move or tilt therein relative to said base; and c) placing a plurality of barrier modules on or above said elongated base, and coupling each barrier module to at least one of said coupling rods to thereby permit said barrier modules to move relative to said base and absorb more impact energy of said colliding vehicle.

18. A method according to claim 17, wherein placing the plurality of barrier modules comprises: (i) placing the plurality of barrier modules on top of the elongated base; (ii) connecting between adjacently located barrier modules by engaging mating shoulders provided in said barrier modules; and (iii) placing one of the coupling rods in a pass-through bore defined in the mating shoulders of each of the adjacent barrier modules, such that end portion of said coupling rod is received in one of the cushioning channels provided in the elongated base.

19. A method according to claim 17, comprising interconnecting adjacently located segments of the elongated base by passing a stake through a connecting bore provided in mating shoulders of said adjacently base segments.

20. A method of converting a conventional stepped crash barrier to a crash barrier having improved energy absorbance properties, the method comprising: horizontally sawing said conventional crash barrier and removing its upper portion while leaving its lower portion in place; drilling cushioning channels spaced apart in said lower portion; placing a plurality of coupling rods in said cushioning channels; and attaching to said coupling roads at least one of: a cable, a plurality of barrier beams, a plurality of barrier modules.

21. The method of claim 20, comprising filling the drilled cushioning channels with energy absorbing material.

* * * * *